US008091201B2

(12) United States Patent
Johnson et al.

(10) Patent No.: US 8,091,201 B2
(45) Date of Patent: Jan. 10, 2012

(54) STAMPED TUBULAR MEMBER AND METHOD AND APPARATUS FOR MAKING SAME

(75) Inventors: Douglas M Johnson, Dorr, MI (US); Robert L Middleton, Sr., Middleville, MI (US); Robert L Middleton, Jr., Middleville, MI (US); Robert E. Leedy, Hastings, MI (US); John A. Nobel, Shelbyville, MI (US)

(73) Assignee: Middleville Tool & Die Co, Inc, Middleville, MI (US)

( * ) Notice: Subject to any disclaimer, the term of this patent is extended or adjusted under 35 U.S.C. 154(b) by 1534 days.

(21) Appl. No.: 11/427,512

(22) Filed: Jun. 29, 2006

(65) Prior Publication Data

US 2007/0000973 A1 Jan. 4, 2007

Related U.S. Application Data

(60) Provisional application No. 60/695,374, filed on Jun. 30, 2005.

(51) Int. Cl.
*B21D 39/03* (2006.01)
*B23P 11/00* (2006.01)

(52) U.S. Cl. ..... 29/428; 29/563; 29/889.61; 29/897.2; 72/38; 72/45; 72/349; 228/125; 219/61; 219/105

(58) Field of Classification Search ..... 29/421.1, 29/428, 454, 563, 889.61, 890, 897.2; 72/38, 72/45, 55, 60–63, 349; 228/125, 144, 146, 228/151, 173.6; 219/61, 67, 62, 105, 614
See application file for complete search history.

(56) References Cited

U.S. PATENT DOCUMENTS

| | | | | | |
|---|---|---|---|---|---|
| 1,934,374 | A | * | 11/1933 | Phelps | 219/67 |
| 1,970,231 | A | * | 8/1934 | Habicht | 74/607 |
| 2,025,741 | A | * | 12/1935 | Hansen | 219/67 |
| 2,240,170 | A | * | 4/1941 | Borgadt | 219/67 |
| 2,976,611 | A | * | 3/1961 | Giffen | 228/151 |
| 3,452,415 | A | * | 7/1969 | Beazley et al. | 29/898.047 |
| 3,535,484 | A | * | 10/1970 | Pegues et al. | 219/67 |
| 4,860,570 | A | | 8/1989 | Perrault et al. | |
| 4,991,419 | A | | 2/1991 | Kuroda et al. | |
| 5,312,080 | A | * | 5/1994 | Mazur et al. | 248/300 |
| 6,408,670 | B1 | | 6/2002 | Trapp | |
| 6,418,611 | B1 | | 7/2002 | Weber et al. | |
| 6,591,648 | B1 | | 7/2003 | Ash et al. | |
| 6,892,559 | B2 | | 5/2005 | Lieponen | |
| 6,904,677 | B2 | | 6/2005 | Yamauchi | |
| 6,920,773 | B2 | | 7/2005 | Lieponen | |
| 7,055,353 | B2 | | 6/2006 | Cowie | |
| 2004/0148760 | A1 | * | 8/2004 | Wang | 29/525.06 |

* cited by examiner

*Primary Examiner* — Derris Banks
*Assistant Examiner* — Jeffrey T Carley
(74) *Attorney, Agent, or Firm* — Kane & Co., PLC; Barry C. Kane

(57) ABSTRACT

A unique tubular work piece is disclosed along with a novel method and apparatus for manufacturing tubular work pieces from sheet metal stock lighter and stronger structures with less waste and less cost than prior methods.

18 Claims, 7 Drawing Sheets

STAMPED TUBULAR MEMBER AND METHOD AND APPARATUS FOR MAKING SAME

CROSS REFERENCE TO RELATED APPLICATION

This application claims priority from U.S. provisional patent application entitled, "TUBULAR MEMBER AND METHOD AND APPARATUS FOR MAKING SAME," assigned Ser. No. 60/695,374, and filed Jun. 30, 2005, the contents of which are incorporated herein by reference.

BACKGROUND OF THE INVENTION

1. Field of the Invention

This invention is in the field of tubular products and bodies, and specifically to a unique tubular product, and method and apparatus for manufacturing such tubular products.

2. Description of the Related Art

The history and background of making tubes and pipes is fairly well known and will not be addressed in any detail herein. It is sufficient for the purposes of this application to simply state that since the first log and clay pipes, technology has made substantial advances.

Relatively recently in history roll-forming methods have been used to manufacture pipes and tubes from flat sheets of metal. In its most fundamental form, roll-forming imparts a radius to the flat metal stock as it is passed a plurality of times through one or more rollers. The rollers, referred to as roller dies, are precision made for each job. Each roller die is referred to as a station. As the sheet metal passes through each station, each roller changes the profile of the metal. The successive rolling through the roller dies allows for profiles that are substantially closed or open. These profiles have enormous application in manufacturing, commercial building, aerospace and other applications. Parts can be fabricated from aluminum through 6 gauge steel (½" thick).

Additional operations may "pre-punch" holes in precise locations for mounting holes or to reduce weight of the final shape. "Notching" is another operation that may either punch through or punch part of the metal out from the surface. Shapes may be cut to precise length after "roll forming" is completed. When precision is preferred along the seam, roll forming is not an acceptable solution. Moreover, roll forming is unable to produce complex asymmetric profiles. For complex asymmetric profiles other techniques are used.

To produce a complex asymmetric tubular form or profile, extruded aluminum tubes are typically used. The aluminum may be easily formed, bent, or manipulated to produce the desired shape, but not often where all steps are performed in a single manufacturing process. Rather the aluminum tubular product is manufactured at one location, than transferred to another manufacturer who imparts the desired shape or profile to the tubular material.

Hydro-forming is one method often used to produce complex asymmetric tubular shapes. The metal tube may be filled with a liquid, sealed, and inserted into a mold. The liquid-filled tube is compressed within the mold cavity. As pressure is applied the liquid within the tube forces the walls of the tube to deform and conform to the shape of the mold cavity. Alternatively, a high pressure liquid may be introduced into the tube at the same time as external pressure is applied by the press. In the same manner as briefly described above, as the pressure increases, the metal is deformed to the areas of least resistance, forming the tube to the shape of the mold cavity.

Another method of making complex tubular products is casting. Green sane molds may contain a core set-off from the mold cavity by spacers. The molten metal is poured into the mold and allowed to cool. The green sand mold and core are destroyed to remove the finished product.

Yet another method for making complex tubular work pieces is by machining. The advent of computer aided machines now makes the formation of complex shapes rather straight forward. Virtually any complex solid may be machined from one or more billets of material. However, when it comes to machining tubular products, the results are limited especially when the tubular passages are not straight. To the writer's knowledge, no machining technique has yet been designed that can bore curvilinear or serpentine passages through metallic bodies.

U.S. Patent documents discussing the formation of tubular products by roll forming, hydro-forming, and other techniques include 6,920,772; 6,904,677; 6,892,559; 6,591,648; and 4,991,419, the contents of which are incorporated herein by reference.

A disadvantage often associated with making tubular objects using the roll-forming method is that the tubes are often not closed structures. That is to say that a substantial gap is nearly always present formed between the opposing edges of the metal sheet. Hydro-forming and casting methods are often too expensive to justify for many components. Lastly, machining has its own disadvantages limited by access to the interior of structures. As a result, none of the prior known methods are appropriate for manufacturing inexpensive arcuate or serpentine tubular work pieces where precision is important.

The invention described herein solves the disadvantages associated with the prior art by providing a method and apparatus for forming flat stock metal into tubular bodies such as axles, tubular frames, handles, or substantially any rod-like structure previously made from solid stock. The instant invention also achieves these goals with less waste and less expensive raw material than prior methods.

SUMMARY OF THE INVENTION

The present invention provides a method for making a tubular work piece using a series of stamping operations. In general the method includes the step of performing a blank from a web of sheet metal using a punch and a die tool. The preformed blank is then urged into a die to produce a generally U-shaped body. The U-shaped body is subjected to another stamping operation wherein the legs of the U-shaped body are rolled toward one another to begin to close the work piece. From there, another tool completes the roll of the edges of the work piece to substantially complete the formation of the tubular structure. Following the initial formation of the tube, the work piece is subjected to one or more re-striking steps wherein the tubular work piece is essentially compacted, forcing the edges of the work piece together to form a substantially tight seam.

In another form of the invention the wall thickness of the tubular work piece can be modified. The method includes the step of preforming a blank as described above, stamping a blank from a web of sheet metal. The blank may be moved to one or more stamping operations performed by a punch and die tool wherein the blank is drawn at one or more locations into one or more tool cavities to initiate the formation of the tube form. Following the preform, the process of closing the edges of the blank are performed to define the tubular body. Once the work piece has been substantially formed, the method includes re-striking the work piece to substantially close the edges of the work piece forming the seam of the tube. Re-striking may be performed a number of times to compact the tubular work piece to tighten the seam, and change the thickness of the tubular walls, depending upon the desired application.

According to another form of the invention, the method contemplates creating an interlocked seam between the edges of the blank. The interlocked seam may be created by stamping predetermined profiles along the edges of the metal blank, and bringing those profiles into intimate contact with one another during the re-striking step. As the butt-ends of the edges come in contact with one another, the re-striking step causes the profiles along each edge to collide with the opposing edge and deform, holding the opposing edge of the sheet in tight engagement. The tolerance of the seam can be improved by re-striking the work piece in yet a smaller cavity, forcing the seam edges even closer together and increasing to a desired degree, the thickness of the tube wall.

In yet another form of the invention, a method is disclosed for making a tubular work piece, comprising the steps of stamping a blank of predetermined shape from a sheet of metal having a first wall thickness wherein the blank has at least a first end, at least a second end, and at least two opposing edges configured to come into contact with one another. The method further includes forming the blank into a tubular work piece of predetermined profile and dimension using a plurality of dies until the two opposing edges are proximate one another. The butt ends of the two opposing edges are brought together by working the tubular work piece within a confined space. The work piece is then compacted by re-striking the work piece in another of the plurality of dies.

Variations that can be added or included with the method just described include the step of coining at least one end of the work piece after the step of compacting; coining at least one end of the work piece prior to the step of compacting; stamping a predetermined profile along each of the opposing edges prior to the step of forming; stamping interlocking profiles along each of the edges prior to the step of compacting; stamping legs extending from said tubular work piece prior to the step of compacting; and stamping a pierce nut through the blank prior to the step of compacting. Other additional steps that may be incorporated with the basic method include stamping a nipple through the blank prior to the step of compacting; interlocking the opposing edges in butt-end contact; coating an interior wall of the tubular work piece with a polymeric material; injecting an interior of the tubular work piece with a polymeric material; and filing said tubular work piece with a polymeric material to provide structural rigidity.

Another form of the method comprises the steps of stamping a blank from a sheet of metal having a first thickness, the blank having at least a first end, at least a second end, and at least two edges; forming the blank into a tube such that the two edges contact one another; compacting the tubular form in a cavity such that the wall thickness of the sheet of metal is increased at predetermined locations; and filling the tubular form with a polymeric material. Modifications or additions to the method include coining at least one end of the blank following the step of compacting; forming legs that extend from the tubular form during the step of stamping the blank; stamping a pierce nut into the blank; and stamping a profile along each of the edges.

According to another form of the invention, an apparatus for forming a tubular member from flat stock includes a first plurality of tools arranged sequentially on a punch assembly; a second plurality of tools arranged sequentially along a die assembly and designed to engage the tools on the punch assembly in registered alignment when the punch and die assembly engage one another; and at least one set of tools attached to one of the punch and the die holder assembly adapted to engage at least one end of the tubular member to coin at least one end.

In yet another form of the apparatus of the invention, the plurality of tools arranged sequentially on the punch and the die assembly include a preforming station where the initial blanks for the work pieces are formed in the sheet of metal; and a transfer mechanism for moving the blanks sequentially from station to station. The plurality of tools arranged sequentially on the punch and dies assembly include a drawing tool for forming a U-shaped body; a second drawing tool for further defining the profile of the U-shaped body; a roll-over tool for rolling the upright legs of the U-shaped body toward one another; and at least one restriking tool for compacting the work piece in a tool cavity, substantially closing a seam between adjacent edges of the sheet metal, and altering the wall thickness of the work piece. A further embodiment of the apparatus may include ancillary tools for finishing the ends of the work pieces in the latter steps of the method. Such finishing tools include coining, trimming, and flanging, among others.

The advantages offered by the present invention include a method for making complex tubular products and work pieces in a manner that is less expensive than current manufacturing methods. The invention also offers the user the ability to make a substantial number of identical work pieces in less time that previous methods, resulting in a substantial cost savings to both the manufacturer and the end-user. The invention also offers the advantage of producing complex cylindrical, curvilinear or arcuate structures in a manner more efficient than associated with hydro-forming or hot or cold-roll forming.

These and other advantages will become readily apparent to the reader from the detailed description of the different forms of the method, particularly when considered in combination with the drawing figures accompanying the application.

BRIEF DESCRIPTION OF THE DRAWING FIGURES

DETAILED DESCRIPTION OF THE INVENTION

For the express purpose of the following description, the terms "upper," "lower," "right," "left," "rear," "front," "vertical," "horizontal," and derivatives thereof shall relate to the invention as oriented on each page. It should be understood the invention may assume different orientations and/or alternative steps or sequences unless it is expressly specified to the contrary. It should also be understood that the specific structures, devices and processes illustrated in the accompanying drawing figures and described in the following specification are simply exemplary embodiments of the concepts and which are limited or restricted as defined in the appended claims. Hence, specific dimensions and other physical characteristics relating to the embodiments described shall not be considered limiting, unless the claims expressly stated otherwise in the specification or recited by the claims. For the purposes of the following description, reference will be made to a metal web or sheet of metal to be worked on in combination with the invention. The web or sheet of metal will not be shown in combination with the tooling simply for the purposes of simplifying the description and making the images of the tooling easier to identify the component parts. Those skilled in the art will understand the implications of each step in the method described, and should fully appreciate the resulting impact on any sheet of metal or work piece produced as a result of the tool interaction.

Figure 1:
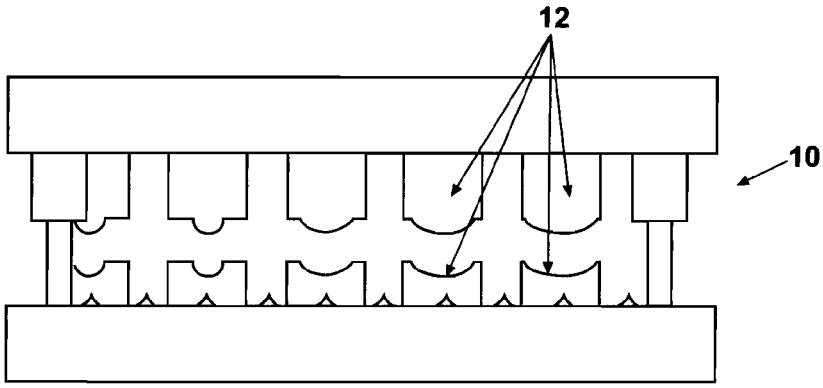
FIG. 1 is an elevation view of a simplified progressive die assembly.

Progressive dies, such as generally identified by numeral 10 shown in FIG. 1, are among the most common type of multiple operation tools currently used in the metal stamping industry. As the name implies, a sequence of punching, drawing, cutting, or other operations are performed on a continuous sheet of metal (not shown) as the sheet progresses through the sequence of tools 12 arranged on the machine 10. The various operations progressively alter the original flat sheet of material until a finished part or work piece is formed and is separated from the sheet material by a final cut off die at the end of the progression. Current progressive die systems such as 10 generally move the work piece from station-to-station by way of a carrier strip, carrier ribbon, or strip skeleton typically formed along the edges of the metal sheet to provide a structural bridge between the parts as the parts are progressively formed along the sequence of dies 12.

The carrier ribbon is typically located along each edge of the metal sheet and is outside of the finished product area. For further information on progressive dies and their operation, the reader is directed to the disclosure contained within U.S. Pat. Nos. 7,055,353, 6,408,670, and 4,418,611, the content of which are incorporated herein by reference.

Figure 2:
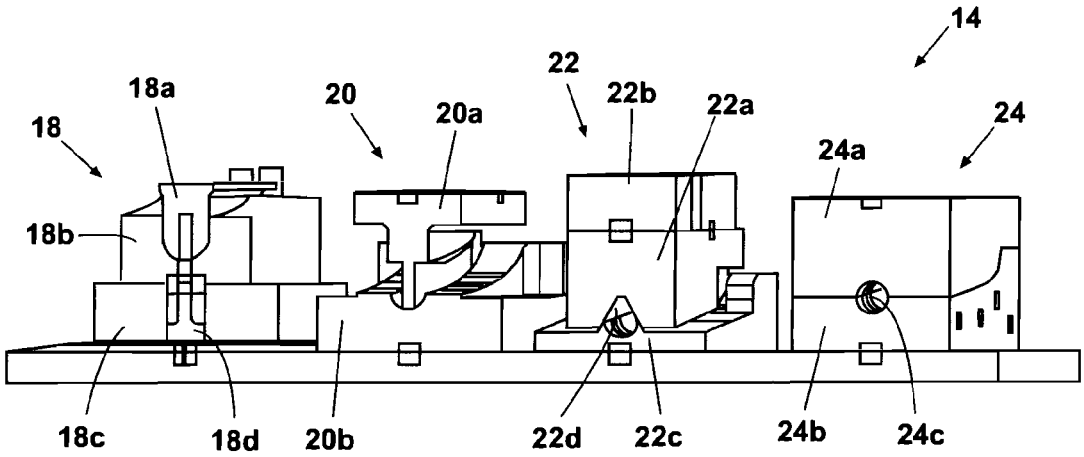
FIG. 2 is a schematic diagram depicting a basic series of punch and die tools for carrying out the invention.
Figure 3:
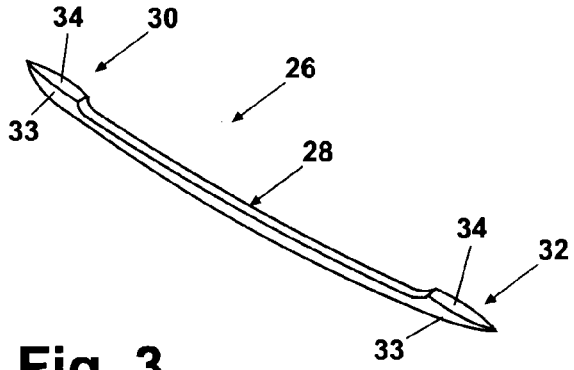
FIGS. 3-7 depict one form of a work piece manufactured according to the invention.
Figure 4:
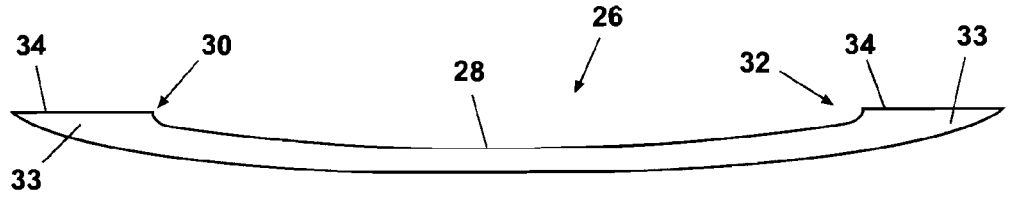
Figure 5:
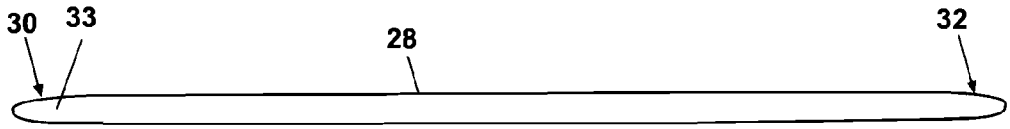

FIG. 2 generally illustrates one example of a progressive die assembly 14 that may be used to produce a tubular work piece in accordance with the invention. In the example shown in FIG. 2, the series of die tools 16 disposed on the progressive die assembly 14 are designed specifically to form an appliance handle of generally arcuate form and specific profile such as the one described below and shown in FIGS. 3-7. For the purposes of this description, only one-half of the die tools are shown so that the reader can appreciate the cross section of the tool cavity formed when the punch and die tool are brought together. Not shown in FIG. 2, but also contemplated to be used in combination with the tools 16 described below are the pre-forming tools commonly used in progressive die operations such as pierce and trim tools, pre-forming tools for modifying the sheet to work with the transfer mechanism, and any finish tools the user may wish to adopt.

Referring to FIG. 2, the work piece, preferably contained within a web or sheet of metal preformed so a blank of the work piece substantially punched from the rest of the sheet metal web is received in station 18 at the left side of the drawing. In a preferred form of the invention, station 18 includes a drawing tool 18*a* attached to the punch assembly (not shown) similar to that described above. The drawing tool 18*a* works in cooperation with a complimentary shaped drawing cavity 18*b* attached to a riser 18*c* that in turn is attached to the die assembly or lower platen of the die assembly. The drawing cavity 18*b* and the riser 18*c* contain a slot to accommodate a piston actuated platform or pad 18*d* that acts to capture the work piece between the drawing tool 18*a* and the platform 18*d* and hold the work piece in place as it is being drawn into the cavity 18*b* to form the initial U-shape form.

Following the formation of the U-shaped body at station 18, the work piece is transferred to station 20 where a second drawing tool 20*a* attached to the punch assembly further defines the profile. The second drawing tool 20*a* works in cooperation with a second drawing cavity 20*b* defined in the lower portion of the station 20. The second drawing cavity 20*b* has a reduced diameter cavity than that provided in cavity 18*b*, and further imparts a tighter curl to the blank. Station 20 may also perform additional functions such as expand or further define the end portions of the work piece and/or generally set the initial shape of the finished product as will become more readily apparent below. After this step in the method, the work piece is generally U-shaped in form with the opposing edges or legs extending substantially vertically from the work piece on each side of the U-shape body.

The third station in the sequence identified by reference numeral 22 starts the process of actually closing the tubular work piece. Station 22 includes an upper cavity punch tool 22*a* depending from a riser 22*b* attached to the punch assembly or platen briefly mentioned above, and works in cooperation with a die cavity 22*c*. The punch cavity 22*d* defined in the tool 22*a* rolls the vertically extending edges or legs of the U-shaped work piece inwardly toward one another until they are approximately in contact with one another. The degree of roll is controlled in substantial part by the angular arc between the side walls of the cavity 22*b*. If the arc is too narrow or shallow, the degree of roll will be less, resulting in a more oblate surface. If the arc is too great or steep, the roll will cause the edges of the steel to dive too sharply back into the U-shaped body, and create a concave surface.

In the embodiment described herein, the profile of the punch cavity 22*c* also changes along its length as the degree of roll and the distance of the deformation change as the overall shape of the work piece changes. More specifically, for the handle shown below, the roll cavity terminates short of the ends of the work piece since the ends are not rolled closed.

Station 24 represents the last step in the most rudimentary form of the invention. Station 24 includes a rather straight forward punch cavity 24*a* and a die cavity 24*b* working in combination with each other to produce a cavity substantially conforming to the outside dimension of the finished work piece. In the event multiple stations 24 are used, it is contemplated that the progression of dimensions will diminish until the final tolerance is accomplished. In the embodiment shown in FIG. 2, it is contemplated that only a single station 24 is required.

Station 24 is referred to below as the re-striking station and is the location where the work piece is compressed and compacted, substantially closing the seam defined by the meeting of the opposing edges of the work piece. As would be surmised the final dimension of the cavity 24*c* defined between 24*a* and 24*b* is the smallest in the series of cavities in the progressive die. Its purpose is to urge the opposing end faces of the blank edges to be forced together such that any gap there between is barely perceptible to the eye. In addition, it is preferred that the tooling is designed to locate the seam at a location along the work piece that is substantially concealed from the end user when the work piece is used. In the case of an appliance for example, it is preferred that the seam be disposed on a side of the work piece oriented toward the appliance and away from the normal line of sight of the end user. In the particular instance of station 24, the seam occurs along the upper most point in the cavity contained within the punch side of the tool 24*a*.

In a preferred embodiment of the invention, the diameter and overall shape of the cavities formed in each of the respective station is just slightly larger than the finished shape and dimension of the final product. Each successive station will preferably provide a progressively smaller cavity to achieve the desired result. This is particularly true for the final stations such as stations 24 (and subsequent similar stations) where the work piece is subjected to re-striking which imparts the final close seam and wall thickness tolerances characteristic to the work piece. As each station becomes progressively smaller, the overall shape of the work product becomes more compact. That is to say that with each stroke of the die assembly, the exterior surface of the work piece receives a force substantially perpendicular or normal to its surface. Because of the tubular structure, and acting much like a keystone works in an arch, the perpendicular force is transferred to the sheet metal adjacent thereto, causing opposing forces about the tubular structure. As the force is increased, any deformation in the work piece 16 occurs in the walls, producing an increase in the overall wall thickness. This annular redistribution of pressure produced by the re-striking step also results in the butt ends of the edges of the sheet metal, now in contact with one another, to conform closely to one another, forming a substantially close fitting seam.

It is anticipated that structure may be imparted to the blank to help urge the seam to be closed tightly and remain that way throughout the life of the work piece. One method contemplated for achieving that task is with the aid of shallow inverted trapezoidal cutouts formed in the respective edges of the blank and configured such that when the edges come together, the male portion of one edge is received within the female portion along the opposite edge, much like a dovetail joint works in joining two pieces of wood in furniture. However in this instance, the degree of angle imparted to the scalloped edges shallow, and the depth or length of each is slightly longer for reason that will become apparent below. When the two cooperating structures are initially brought into contact with one another, the male portion is received within the female portion as the two edges translate toward one another. The tolerances between adjoining structures provide for some area of expansion. When the work piece is subjected to the re-striking process, and the overall tubular structure is compacted, the respective structures defined along the edges are forced against each other, causing each to spread laterally and fully occupy the gap between the adjacent structure, causing the trapezoids to interlock so that they cannot be withdrawn in the same direction in which they were joined. Other interlocking geometric shapes and structures can also be used in place of the inverted trapezoids, such as fingers, crescents, and the like.

Station 24 or its related stations may also be the location where the ends of the work piece receive other steps or processes. As will become more apparent below, tooling adjacent the primary punch and die stations 14 may be included to provide further processes on the work piece.

FIGS. 3-7 illustrate one form of tubular work product 26 that may be produced according to the method generally outlined above. The drawing figures illustrate a generally arcuate handle 26 that may be used on products such as appliances, cabinets, automobile doors, or other handles. The handle 26 includes a tubular central body 28 of a dimension ergonomically adapted to be grabbed by a users hand, and spaced from any surface to make is easy to access. The arcuate central tubular body 28 terminates at each end 30, 32 in a flared skirt 33 open along one side 34 to lie adjacent the substrate. The flat 34 is open to the tubular cavity 35 to provide a recessed location for a coupler (not shown) for attaching the handle to the substrate such as the appliance.

Figure 6:
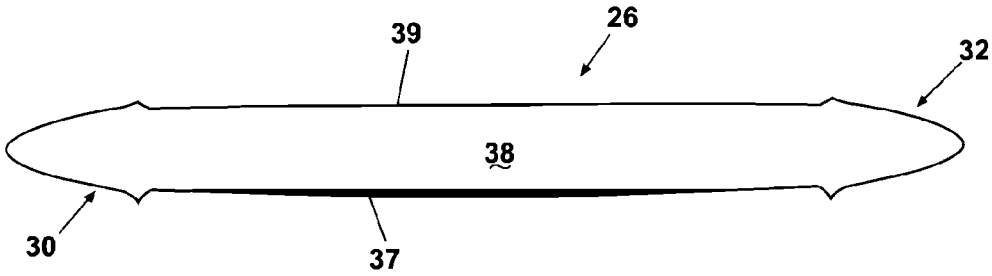

FIG. 6 in the series generally illustrates the pattern required for the handle 26 when in the flat and open state. The work piece 26 has a length greater than its width including a first end 30, a second end 32, and two opposing edges 35 and 37. As one moves along each of the respective edges 37, 39 from the central body 38 toward the ends 30, 32, the profile of the respective edge increases to accommodate for the flair of the skirt portion 33 described above. Unlike bent tubing, the entire profile of the work piece 26 is accommodated by the change in relief provided by the profile of the blank, and by the thinning and drawing of the metal as it progressively moves through the stations in the die assembly.

We have discovered that we can manufacture a light weight, yet rigid structural element in accordance invention. In one example, a flat metal blank may be formed into a tube having an internal diameter as little as approximately five millimeters where the thickness of the wall material has been maintained within +/−0.005 millimeter of the original sheet metal. However tubular structures having wall thicknesses on this order are subject to failure upon the application of bending moments or similar forces.

To increase the strength of the tube without substantially increasing the weight, the interior of the tube may be filled with a polymer material. For example, acceptable materials may be in the form of closed-cell polystyrene, open-cell polystyrene, polyethylene, urethane or polyurethane having a density within the range of 4 pounds to 25 pounds. Additional polymer materials may also be used so long as they cure or harden with a modulus of elasticity within the range, including but not limited to $10\times10^2$ to $10\times10^{16}$ pounds per square inch (psi), preferably within the range including but not limited to $10\times10^3$ to $10\times10^{10}$ psi, and most preferably within the range, including $14\times10^3$ to $800\times10^3$ psi. If greater rigidity and strength is preferred, thermoplastics, thermosetting polymers, or hydrophilic and other two component polymeric materials may be used to fill the tubular cavity. It is expected these types of fillers will provide rigid and dense filler that makes the wall of the work pierce virtually impervious to crimping or failure under normal use. These types of fillers often provide very strong adhesion and could be used to provide a mounting surface or substrate for hardware used to mount the work piece to a second substrate such as an appliance.

Figure 7:
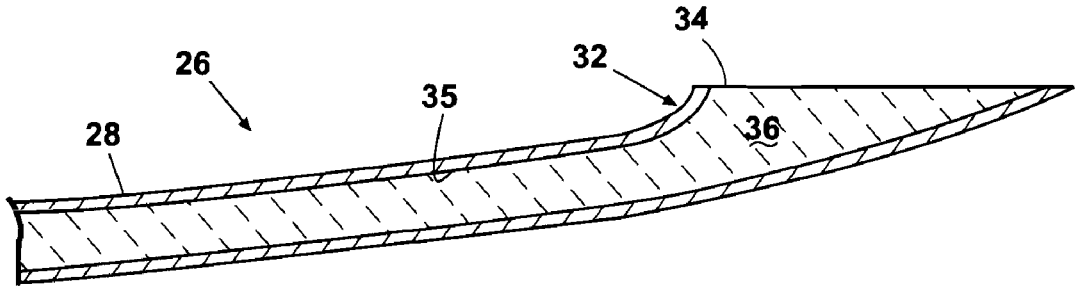
Figure 11:
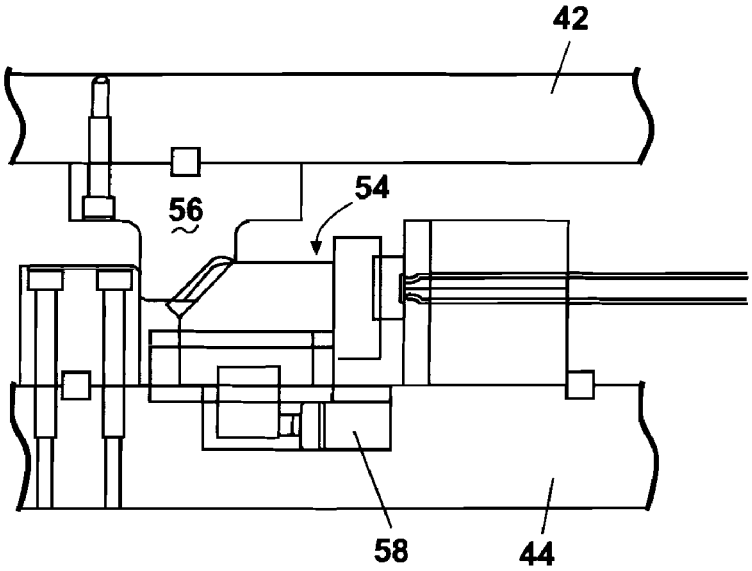
FIG. 11 is fragmentary elevation view of one example of a tool used in conjunction with the invention.

The polymers described above may be placed in the tubular work piece shown in FIG. 7 in a number of ways, including pouring in situ, injection, and spraying. In a preferred embodiment, the polymer 36 may be injected into the cavity 35 formed in the work piece 26 by the interior walls of the metal. Alternatively a preformed polymer filling may be inserted into the tubular cavity prior to the final stamping step closing the tubular structure. It is also contemplated that any filler 36 such as those described above need not be used to fill the entire tubular cavity. As mentioned above, it may be desirable to fill only a portion of the tubular cavity proximate each flared skirt 33 of the handle 26 shown in FIGS. 3-6 to retain the mounting hardware. Alternatively it may be desirable in certain situations to fill only the main or central body portion 28 of the handle 26, again depending upon the gauge of the metal, to prevent the tubular body from crimping under a force.

Figure 8:
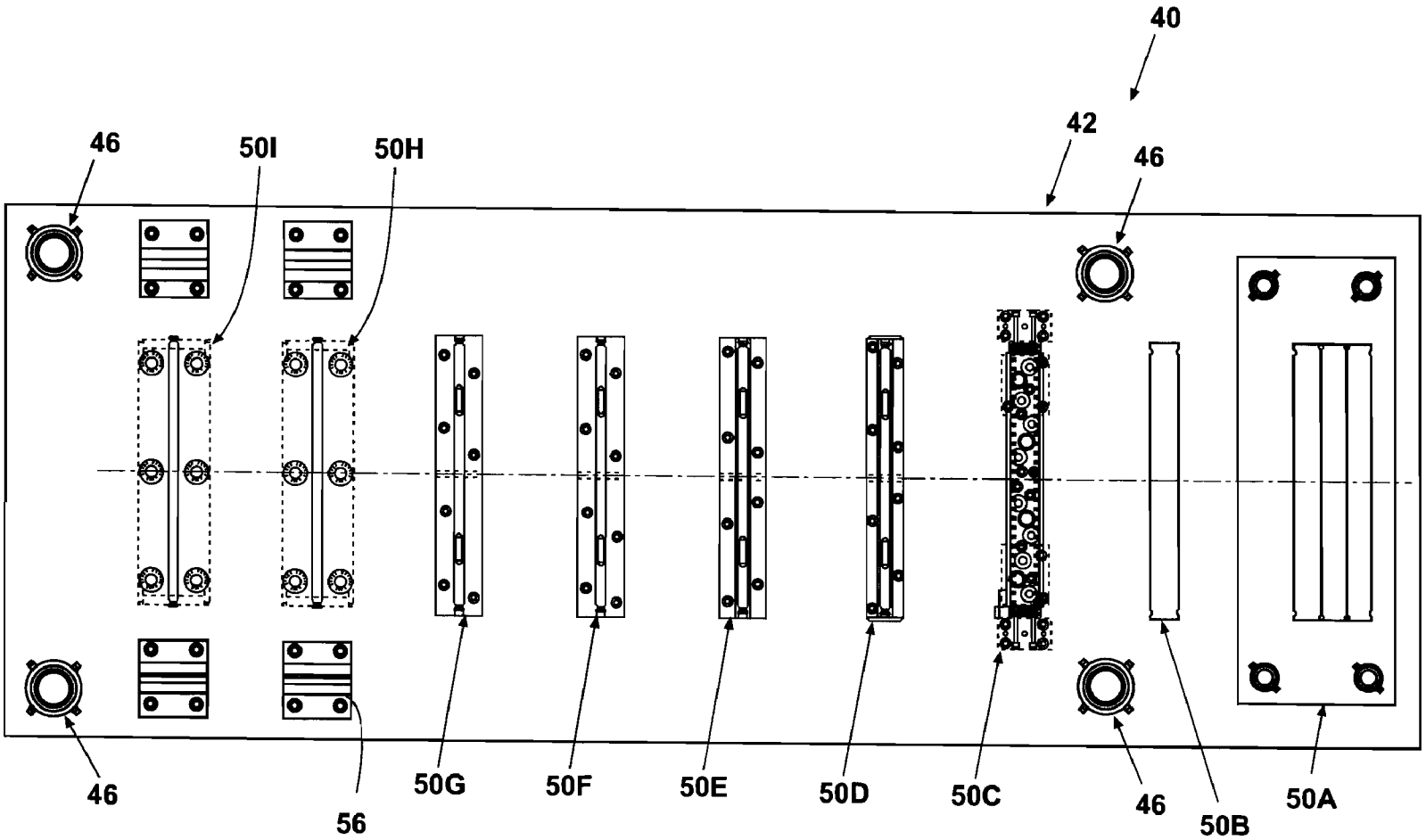
FIG. 8 is a plan view of one form of a punch assembly.
Figure 9:
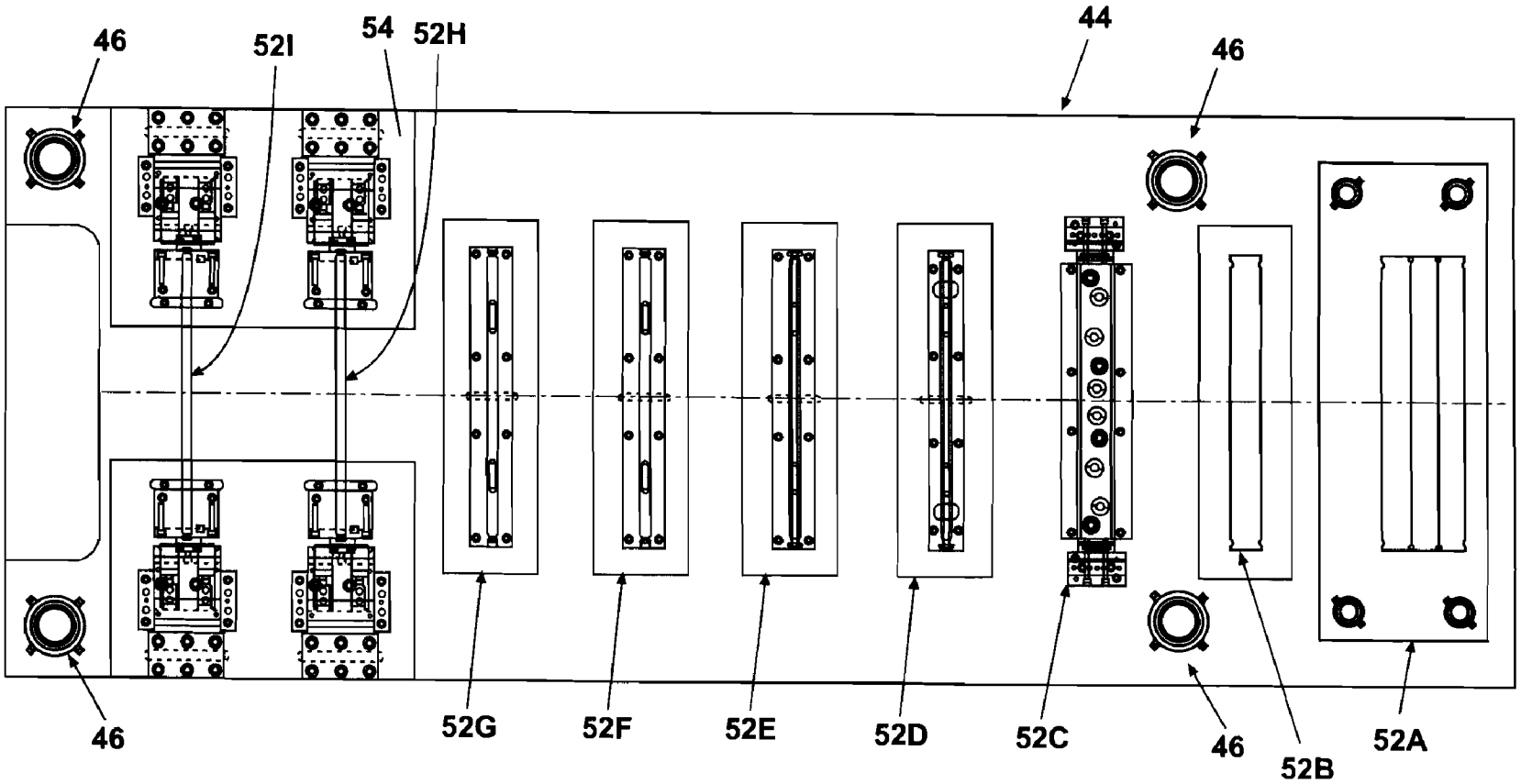
FIG. 9 is a plan view of one form of a die assembly.
Figure 10:
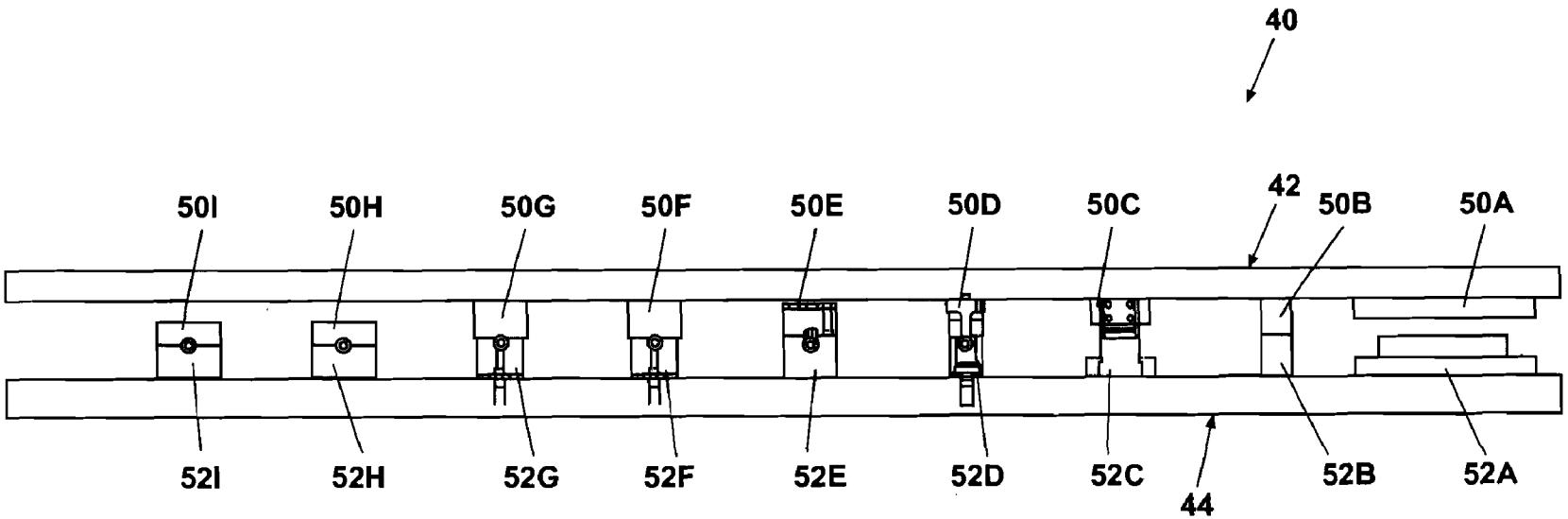
FIG. 10 is a generalized illustration showing the elevation view of the punch and die assemblies shown in FIGS. 8 and 9.

The reader's attention is now directed to FIGS. 8-10 illustrating another embodiment of a progressive die assembly 40 used in conjunction with the invention. Rolls or sheets of steel (not shown) may be passed through a number of stations 50 fixed within a punch assembly generally identified by referenced numeral 42 shown in FIG. 8. The punch assembly 42 is preferably disposed above in registered alignment with the die assembly 44 shown in FIG. 9 using conventional guide pins 46. The punch assembly 42 may be normally spaced from the die assembly 44 by biasing members conventionally used in the industry and often integral with the guide pin assemblies 46. Such biasing mechanisms may include gas, coil, leaf and similar form of springs that permit one of the punch or die assembly 42, 44 to move relative to the other component in compression and be biased in the open position.

Either one of the translating mechanisms (bias or press platen) preferably work in cooperation with a transfer system (not shown) for automatically moving the web or roller of sheet metal from one station 50 to the next sequential station once the desired forming step has been completed. The general methodology of using a progressive die system should be understood by those of ordinary skill in the art. However, it is the application of this basic technology to form a cylindrical object from flat stock that one of ordinary skill in the art would not necessarily be familiar with or find obvious to carry out.

The punch and die assemblies 42 and 44 are illustrated such that the reader is viewing the functional side of each—that is the side where the work is being performed. Referring to FIG. 8, the punch assembly 42 comprises a plurality of stations generally identified by reference numeral 50, including a punch station 50A, a first and second preform stations 50B, 50C, a U-forming station 50D, a form-over station 50E, and roll station 50F, a re-strike station 50G and at least one and preferably two cam-forming stations 50H and 50I. Depending upon the thickness or gauge of the steel or other metal to be worked, one or more of these stations 50A-50H may be incorporated or utilized in the method for manufacturing the work piece.

Referring to FIG. 9, the reader should recognize corollary or mating structures that work in combination with each of the stations identified in FIG. 8 to help form the desired structure in the sheet metal or steel. These include the mating portions of the punch station 52A, the female portions of the preform stations 52B, 52C, the U-forming cavity 52D, the form-over cavity 52E, the roll-over cavity 52F, the re-strike cavity 52G, and the two assemblies 52H and 52I provided to form the ends of the work pieces.

In operation, a blank of steel contained within the web of sheet metal passing through the progressive die is moved into position between the upper and lower punch station 50A, 52A. Upon actuation of the assembly, the metal blank is substantially punched from the metal web or sheet to free the basic dimensions of the work piece from the surrounding metal web. It is this stage of the process where the edges of the metal blank may be formed to include the square or trapezoidal scallops configured to match with the opposite edge and interlock the edges during the forming process.

Subsequent to the punch or basic cutting of the part outline, the metal blank and basic form (work piece) are transferred to the subsequent station 50B, 52B where the punch and the die begin the initial steps of preforming the flat stock into a cylindrical form. The first of the preform stations 50B, 52B initiates the bending of the flat stock by drawing the flat steel into a semi-cylindrical cavity of predetermined radius defined within the die portion of the tool. The subsequent station 50C, 52C further draws the metal blank into a slightly tighter radius approximating that of the finished part.

Once the lower half of the cylindrical or U-shaped body has been accomplished at stations 50 and 52 A-D, the remainder of the cylindrical form is closed at stations 50 and 52 E-G similar to that described above. The die cavities formed by stations 50E-50G act upon the edges of the work piece extending from the U-shaped body and above the die portions of the tools holding the work piece. See FIG. 10. The cylinder form is substantially closed by the compression action occurring at the re-strike station 50G, 52G.

The final forming steps occur at stations 50 and 52H and 52I. At each station the work pieces are held in position by the punch and die assembly 42, 44. As an option to the method, additional tooling may be provided on the progressive die to perform additional processes on the work piece. For example, tool 54 shown in FIG. 9 is attached to the die assembly 44 and designed to translate transversely to the path of the web to engage the ends of the work piece. In one embodiment of the invention, tool 54 may chamfer the ends of the work piece or otherwise modify or alter the end of the work piece depending upon the desired result. For example, in certain circumstances tool 54 may be designed to finish an end of the work piece by grinding away excess material or otherwise bring the end within a certain specification or finish.

According to another form of the invention, the punch assembly 42 may include a frustum or wedge shaped member 56 adapted to engage a corresponding inclined or wedge shaped surface on the tooling such that as the two components come into engagement, the two engaging wedged surfaces cause the tooling to translate inwardly to engage the ends of the work piece. As the tooling 54 translates inwardly, a mechanism may be provided such that the tooling is automatically actuated to perform the desired operation. One example may be a clutch mechanism on the tool 54 designed to engage a continually running drive member disposed within the die assembly 44 whereby the drive would actuate the tool as the tool contacted the work piece. Once the step had been completed, ejectors disposed in the last of the dies holding the work piece could be used to pop the work piece from the assembly 40 into a bin (not shown).

Figure 12:
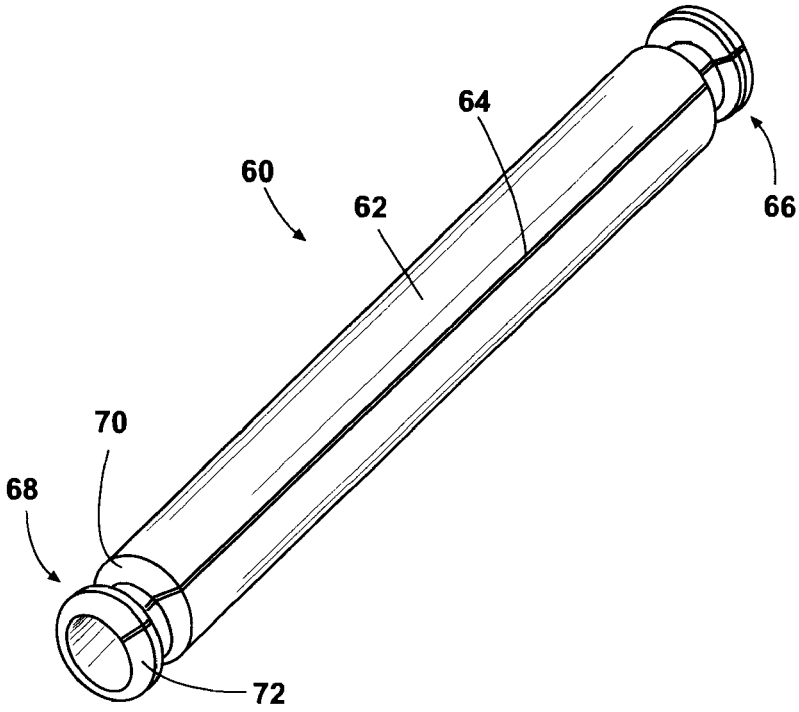
FIG. 12 depicts one form of an axle manufactured according to the invention.

FIG. 12 illustrates in broad terms one form of tubular structure that may be manufactured in accordance with the method of this invention. The designs and applications are substantially limitless. One form of an axle 60 shown in FIG. 12 includes a substantially tubular body 62 of predetermined outside diameter and a length suitable for the desired application. The tubular body 62 is substantially continuous broken by a longitudinal gap 64, the origins of which will become readily apparent below. Proximate the ends 66, 68 of the axle 60, the outside diameter may be reduced to form an annular channel 70 designed to receive C-clips or other forms of retainers to maintain the relative position of an object along the axle, such as a wheel (not shown) or to retain the axle itself within another structure. Outboard of the annular channels 70, the ends 66, 68 may be contoured or chamfered 72 to provide easy insertion of the axle 60 into other structures, and reduce any sharp edges that may come in contact with a user.

Figure 13:
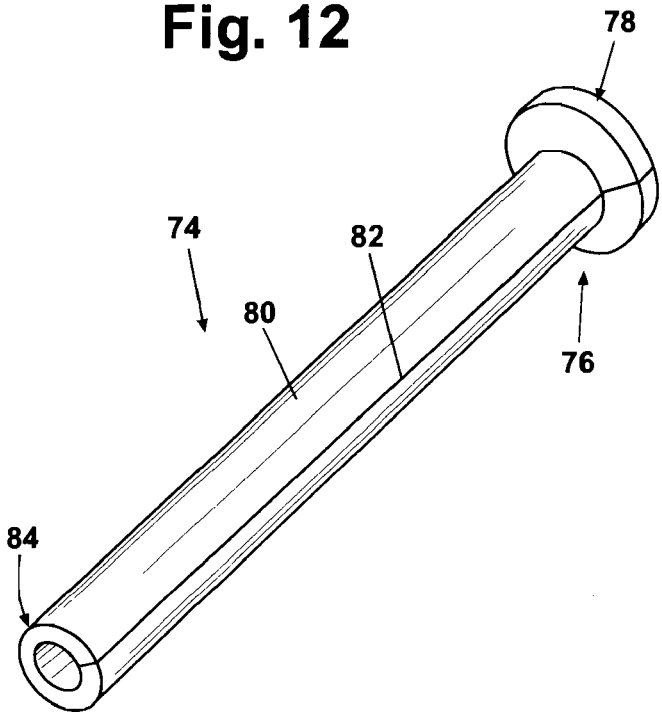
FIG. 13 depicts one form of a tubular pin manufactured according to the invention.

FIG. 13 illustrates yet another tubular body (in this case an axle or pin) 74 manufactured in accordance with the method described above. In this embodiment the pin 74 may be used as an axle or coupling pin such as used to pivotally couple one object relative to another. In this embodiment, the pin 74 includes a predetermined outside diameter and length suitable for the particular application. One end 76 of the pin includes a head 78 substantially larger in outside diameter than the main body 80 of the pin 74. Throughout its length, pin 74 includes a substantially continuous cylindrical body but for the interruption defined by the longitudinal seam 82 extending the length of the pin from one end 84 to the opposite end 76.

Both of the embodiments described above are preferably manufactured from flat or sheet metal or steel. It is also preferred that the sheet metal, steel or stainless steel be formed into the desired shape using the progressive stamping technique described above.

These principal advantages offered by this invention include the formation of substantially any form of tubular body for use in substantially any application previously fulfilled by similar products manufactured from solid stock or more expensive techniques. The tubular work pieces manufactured in accordance with the method of this invention provide a substantially strong component at less cost. Moreover, the method of manufacturing the tubular work pieces enables the user to build such structures from the more commonly available and less expensive raw material.

The above description is considered that of the preferred embodiments only. Modifications of the invention will occur to those skilled in the art and those who make or use the invention. Therefore, it is understood that the embodiments shown in the drawings and the examples set forth herein are described merely for illustrative purposes and not intended to limit the scope of the invention as interpreted according to the principles of patent law, including the doctrine of equivalents.

The invention is:

1. A method for manufacturing a tubular work piece, comprising the steps of:

providing a blank having a first wall thickness and at least two opposing edges;

stamping said blank into an over-sized tubular form using a plurality of successive stamping dies until said at least two opposing edges are proximate one another;

stamping said substantially tubular form within another of said plurality of successive stamping dies until said at least two opposing edges abut one another substantially forming the tubular work piece; and stamping the substantially formed tubular work piece in yet another of said plurality of successive stamping dies to tightly abut said at least two opposing edges against one another, closing a seam of the tubular work piece, and compacting the substantially formed tubular work piece into a finished tubular work piece.

2. The method as defined in claim 1, further comprising the steps of coining at least a first end of said work piece after the step of compacting.

3. The method as defined in claim 1, further comprising the step of coining at least a first end of said work piece prior to the step of compacting.

4. The method as defined in claim 1, further comprising the step of stamping a predetermined profile along each of said at least two opposing edges prior to the step of stamping said blank into an over-sized tubular form.

5. The method as defined in claim 1, further comprising the step of stamping interlocking profiles along each of said at least two opposing edges prior to the step of compacting.

6. The method as defined in claim 1, wherein the step of stamping said blank comprises the step of cold forging.

7. The method as defined in claim 1, further comprising the steps of interlocking said at least two opposing edges end-to-end.

8. The method as defined in claim 7, wherein the step of interlocking provides torsional rigidity to said tubular work piece.

9. The method as defined in claim 1, further comprising the steps of coating an interior wall of said tubular work piece with a polymeric material.

10. The method as defined in claim 8, wherein the step of coating said interior wall comprises the step of injecting an interior of said tubular work piece with a polymeric material.

11. The method as defined in claim 8, wherein the step of coating said interior wall comprises the step of filling an interior of said tubular work piece with a polymeric material.

12. The method as defined in claim 1, further comprising the step of filing said tubular work piece with a polymeric material following the step of compacting.

13. The method as defined in claim 1, further comprising the step of filing said tubular work piece with a polymeric material prior to the step of compacting.

14. The method as defined in claim 1, further comprising the step of filing said tubular work piece with a polymeric material during the step of compacting.

15. The method as defined in claim 1, wherein the step of stamping said blank into a substantially arcuate tubular form comprises the steps of drawing said blank into a generally U-shaped body at a first station; and stamping the upper ends of said generally U-shaped body toward one another in one or more of said plurality of successive stamping dies.

16. A method for making a tubular work piece from a blank of flat material, comprising the steps of:

providing the blank with a first wall thickness and predetermined shape based upon the geometry and dimension of a finished tubular work piece, said blank having at least two opposing edges stamping said blank using a plurality of successive stamping dies to substantially form said blank into a tubular form of predetermined arcuate shape;

stamping said tubular form of predetermined arcuate shape in yet another of said plurality of successive stamping dies to bring said at least two opposing edges proximate one another and substantially close a side of said tubular form;

stamping said substantially closed tubular form in yet another of said plurality of successive stamping dies having a dimension substantially equal to a finished tubular work piece, forcing said at least two opposing edges firmly against one another and substantially completing the forming of the tubular work piece.

17. A method for making a arcuate tubular work piece from flat stock, comprising the steps of:

providing a blank having a shaped based upon the arcuate geometry of the finished tubular work piece, said blank have a first wall thickness and at least two opposing edges;

stamping said blank in a first plurality of successive stamping dies to bring said at least two opposing edges generally together in a manner to substantially form said blank into a arcuate tubular form;

stamping said blank in a second plurality of successive stamping dies to substantially bring said at least two opposing edges together to form a seam along said tubular form; and stamping said blank in at least a third successive stamping die to compact and compress said tubular form into a finished arcuate shape and form using a stamping die cavity smaller than any previous stamping die, forcing said at least two opposing edges into intimate contact with one another and increasing said first wall thickness.

18. A method for progressively forming an arched tubular work piece, comprising the steps of:

providing a flat sheet of metal stock having a first wall thickness;

feeding said flat sheet of metal stock into a stamping assembly having a plurality of tool stations;

punching a blank substantially from said flat sheet of metal stock at a first station;

draw-forming said blank into a substantial arched U-shape at a second station forming two leg members spaced from one another and each having a longitudinal edge;

bending said two leg members toward one another in at least a third station so that said longitudinal edges of said two leg members are proximate one another substantially forming a tube;

stamping said substantially formed tube in at least a fourth station radially compressing said tube to force said longitudinal edges of said two leg members together to complete an over-sized tubular shape;

radially compacting said over-sized tubular shape at a fifth station to a reduced finished size, and thereby increasing said wall thickness of the metal forming said tubular shape and substantially forming a completed work piece; and moving said substantially completed work piece to a storage bin.

* * * * *